US005097692A

United States Patent [19]

Brugman

[11] Patent Number: 5,097,692

[45] Date of Patent: Mar. 24, 1992

[54] BENDING APPARATUS

[75] Inventor: Johannes A. H. Brugman, Rotterdam, Netherlands

[73] Assignee: Hunter Douglas International N.V., Willemstad, Netherlands Antilles

[21] Appl. No.: 533,137

[22] Filed: Jun. 6, 1990

[30] Foreign Application Priority Data

Jun. 14, 1989 [GB] United Kingdom ..... 8913672

[51] Int. Cl.[5] ..... B21D 7/08

[52] U.S. Cl. ..... 72/170

[58] Field of Search ..... 72/168, 177, 179-181, 72/166, 170

[56] References Cited

U.S. PATENT DOCUMENTS

| | | | |
|---|---|---|---|
| 1,459,660 | 6/1923 | Felten | 72/168 |
| 3,452,568 | 7/1969 | Vihl | 72/177 |
| 4,177,702 | 10/1978 | Foster | 72/173 |
| 4,615,199 | 10/1986 | MacLeod | 72/166 |
| 4,707,232 | 11/1987 | Batzill et al. . | |

FOREIGN PATENT DOCUMENTS

| | | | |
|---|---|---|---|
| 3022671 | 1/1982 | Fed. Rep. of Germany | 72/180 |
| 19763 | 5/1984 | Japan | 72/177 |

*Primary Examiner*—Daniel C. Crane

*Attorney, Agent, or Firm*—Fleit, Jacobson, Cohn, Price, Holman & Stern

[57] ABSTRACT

An apparatus method for bending channel cross-section strip or panel material in which the material is passed between an infeed roller set 10, 16, 18, an intermediate roller set 12, 20, 22 and an outfeed roller set 14, 24, 26. At least one of the rollers of each roller set has two axially spaced annular projections which define an accommodation space for the flanges of the strip material. The axial spacing between these annular projections is reduced between the infeed and outfeed roller sets to enable the panel cross-section to be retained over a wide range of panel materials and curvature.

14 Claims, 2 Drawing Sheets

Figure 1:
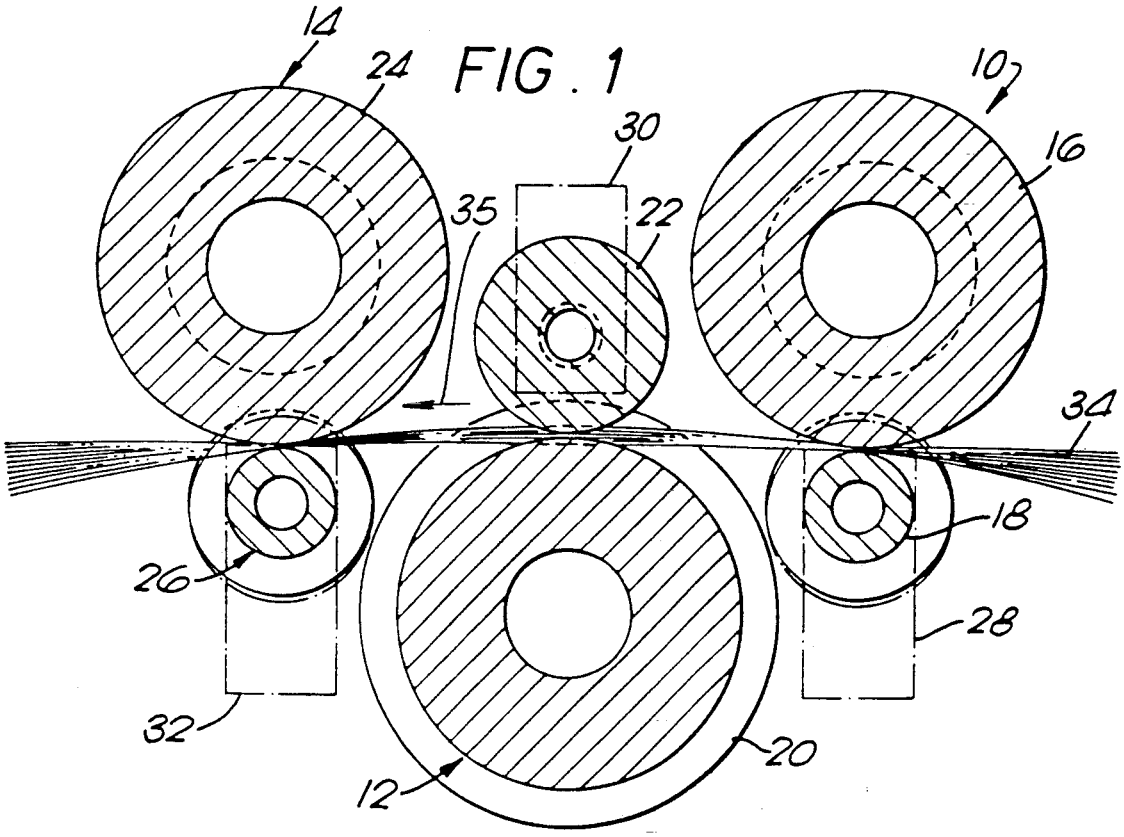

14
24

10
30
16
35
22
34
18
26
28
32
20
12

B1
16

10
38
38
40
40
36
36
A1
18

BENDING APPARATUS

The present invention relates to a bending apparatus and method for giving a longitudinal curvature of a predetermined radius to a length of thin, constant channel cross-section profile strip or panel of permanently deformable material.

Such material is often used for lining walls and ceilings and it is sometimes necessary to produce a longitudinal curvature in such strip or panel material.

It is proposed to use, for this purpose, an apparatus which includes an infeed roller set, an outfeed roller set and an intermediate roller set, each set having a main roller and a support roller, whereby the main rollers of the infeed and outfeed roller sets engage with one surface of the strip or panel and the main roller of the intermediate roller set engages with the opposite surface of the strip or panel The intermediate roller set is offset with respect to the infeed and outfeed roller sets and drive means are provided for driving at least one of the main rollers and/or at least one of the support rollers. Whilst such an apparatus is generally satisfactory, it is not always possible for the preformed cross-section of the strip or panel material to be exactly retained whatever is the chosen radius of curvature, to allow for subsequent mounting of the curved panels. Any deviation in cross-section or dimensional shape would render the panels unacceptable.

With the known apparatus, in the general effort to control the cross-sectional panel shape, the mating supporting rollers have been added to each main roller to enclose and support the panel cross-section in all its critical areas. However, due to the unpredictable behaviour and spring back of the panel material it has not yet been possible to produce entirely satisfactory results. Any successful compensation to the panel cross-section at a given radius of curvature has only been any good for one type of panel material, whereas differences in material thickness, metal alloy and curvature have prohibited general application of this bending technique.

It is now proposed, according to the present invention, that the infeed and/or outfeed roller sets should each be provided with axially spaced annular enlargements which define an accommodation space for each of the side flanges of the strip material, the annular enlargements forming each of said spaces having a shape conforming to at least the shape of the outer surface of the relevant side flange and abutting or nearly abutting the frontal surface of the free end of the relevant flange, the volume and shape of the corresponding accommodation spaces of the infeed roller set and the outfeed roller set for a relevant flange being identical or nearly identical, but the axial distance between the axially outermost points of the sides of the accommodation spaces of the outfeed roller set being smaller than the corresponding distance for the infeed roller set.

With this reduction in the distances it has been found possible to retain the panel cross-section over a wide range of panel materials and curvatures.

The reduction in the distances is relatively small, being preferably between 0.5 and 4% reduction between the infeed roller set and the outfeed roller set.

It has been found, surprisingly, that using the apparatus according to the invention the apparently illogical and seemingly impossible restriction in the shape and dimension compensates for all the possible spring back or material behaviour, within a very useful range.

Advantageously the intermediate roller sets are also provided with axially spaced annular enlargements which define accommodation spaces identical or substantially identical to that of the infeed roller set and preferably these annular enlargements have an axial distance therebetween which is smaller than the corresponding distance for the infeed roller set but larger than the outfeed roller set.

Desirably the rollers of at least one of the roller sets each consist of two or more roller sections, so that the annular enlargements defining the accommodation spaces can be adjusted axially with respect to one another whereby the mutual distance between at least the two accommodation space forming sections of a roller set is adjustable, to modify the percentage reduction of the distance between the outer points of the sides of the relevant accommodation spaces.

The present invention also provides a method for giving a predetermined longitudinal curvature to a length of thin, constant, channel cross-section profile strip or panel of permanently deformable material, said cross-section including a web and two side flanges of a given shape, said method including the steps of feeding the strip through an infeed, an intermediate and an outfeed roller set, of which the intermediate roller set is offset with respect to the others, one of the rollers of at least said infeed and said outfeed roller sets each being provided with annular axially spaced enlargements which define with the other roller of the set an accommodation space for each of the side flanges of the strip or panel, said spaces each having a shape conforming at least to the outer side of the flange and abutting or nearly abutting the frontal surfaces of the two ends of said flanges, the volume and shape of the corresponding accommodation spaces of the infeed and outfeed roller sets being identical or nearly identical; choosing the axial distance between the annular enlargements defining the accommodation spaces of the intermediate roller set and/or the corresponding distance of the outfeed roller set such that it is reduced with respect to the corresponding distance of the infeed roller set; ensuring that the reduction is not compensated by a lengthening of the profiled side flanges in a direction transverse to the length of the strip or panel or by external deformation of the profiled side flanges or other part of the strip or panel, and choosing the amount of reduction as a function of the material, the dimensions and/or the shapes of the strip or panel and of the required bending radius, so as to produce an arcuate profiled strip or panel of which the shortest distance between the free ends of the profiled flanges of that strip or panel after the bending operation is equal or substantially equal to the corresponding distance before the bending operation.

Figure 2:
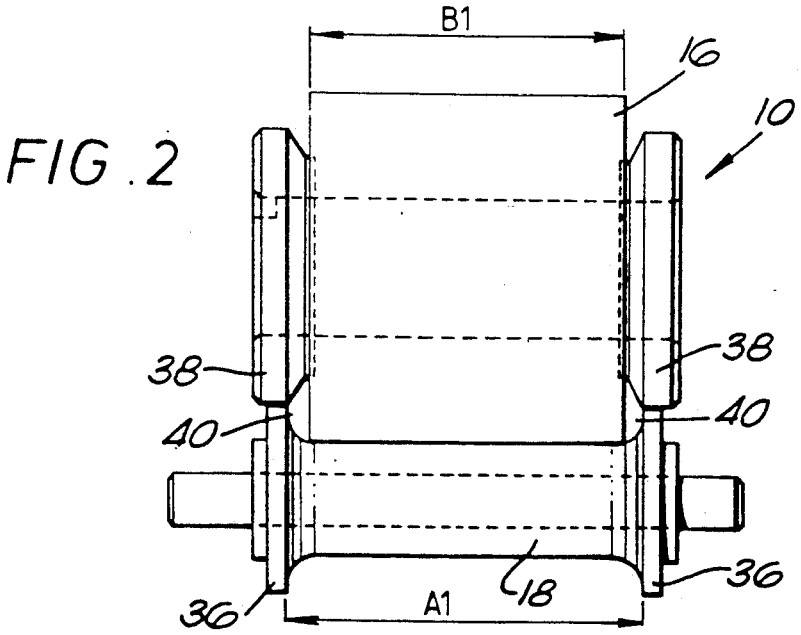

In order that the present invention may be more readily understood, the following description is given, merely by way of example, reference being made to the accompanying drawings, in which:

FIG. 1 is schematic side elevation of one embodiment of bending apparatus according to the invention, taken in cross-section transverse to the axis of the roller sets; and FIGS. 2., 3 and 4 are elevations of the infeed roller set, the intermediate roller set and the outfeed roller set respectively.

Referring now to FIG. 1, it will be seen that the apparatus includes an infeed roller set 10, an intermediate roller set 12 and an outfeed roller set 14.

The infeed roller set includes a main roller 16 and a support roller 18, the intermediate set includes a main roller 20 and a support roller 22 and the outfeed roller set 14 includes a main roller 24 and a support roller 26.

The roller sets are adjustable relative to one another on bearing assemblies 28, 30, 32 to allow the roller sets to be adjusted. In fact only roller set 12 needs to be adjustable or alternatively both roller sets 10 and 14 need to be adjustable to give the desired curvature to the strip material indicated at 34, which is fed from right to left as indicated by the arrow 35.

If reference is made to FIG. 2, for example, it will be seen that the roller sets 10 includes the main roller 16 and support roller 18 with a small clearance left therebetween for the passage of the strip material. The support roller 18 has a pair of axially spaced enlargements 36 and the main roller 16 has a pair of co-operating annular cheeks 38. The main roller 16 is shown as having a axial length B1 and the annular enlargements 38 are shown as having being spaced by an axial distance A1 which is, of course, larger than B1 and defines a pair of accommodation spaces 40.

Figure 3:
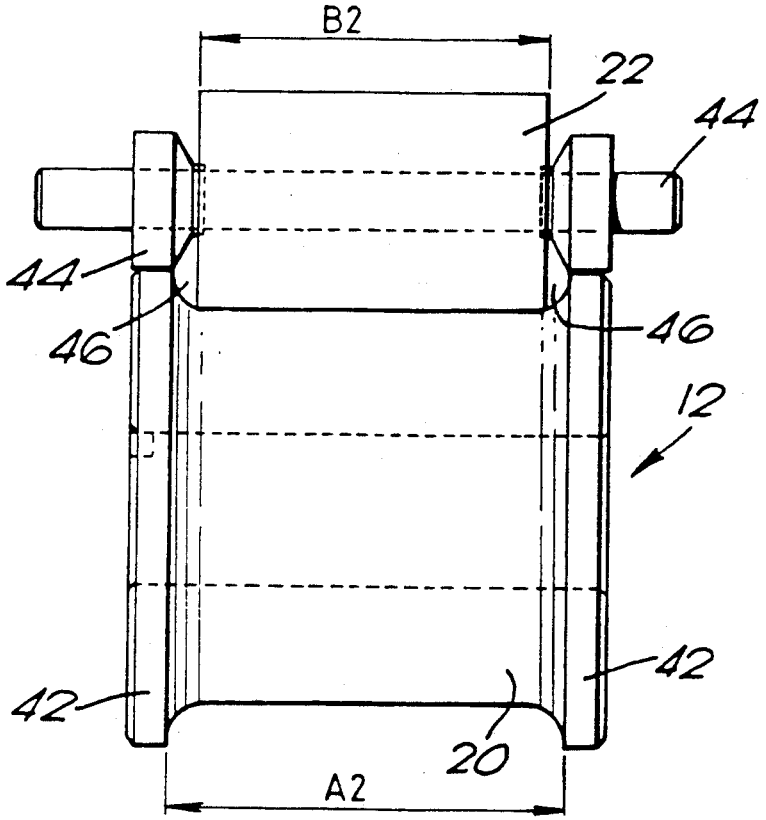

Referring now to FIG. 3, it will be seen that the main roller 20 of the intermediate roller set 12 is also provided with annular enlargements 42, the support roller 22 having annular cheeks 24 which define, with the annular enlargements 42, accommodation spaces 46.

Figure 4:
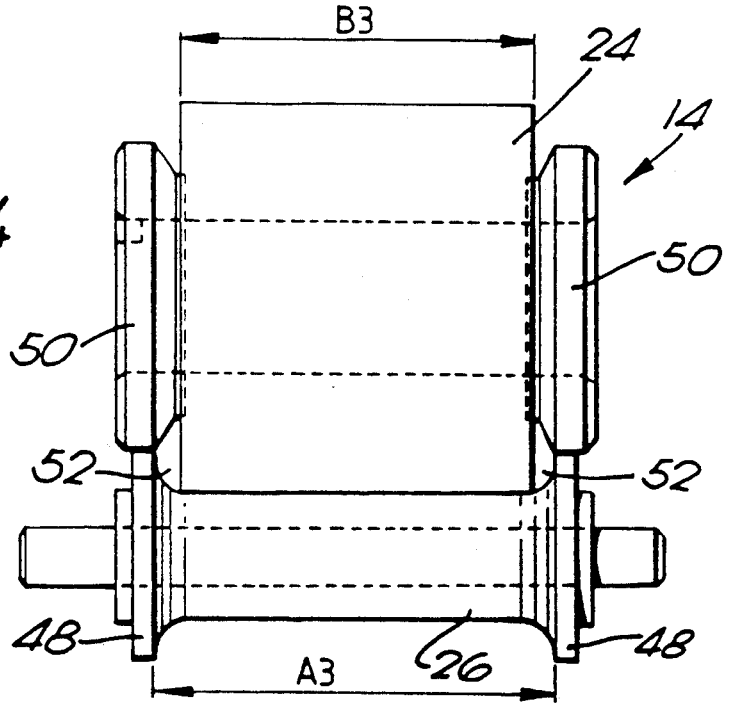

FIG. 4 illustrates that the structure of the outfeed roller set 14 is generally similar to the infeed roller set 10, the support roller having annular enlargements 48, the main roller 24 having annular cheeks 50 defining with the annular enlargements 48 accommodation spaces 52.

The respective distances A1, A2, A3 between the annular enlargements decrease over the subsequent roller sets 10, 12, 14. In one particular construction according to the invention in which, in each instance, the main roller of each set has a diameter of 82 mm, the distances A1, A2, and A3 are 84, 83.2 and 82.4 mm respectively.

Similarly the axial lengths of B1, B2, B3 of the main rollers reduce and in this embodiment as mentioned above, these distances are 74, 73.2 and 72.4 mm respectively.

It should be understood that these dimensions are purely illustrative. The reduction in the distance A1–A3 is about 1.9% and reduction in the axial length B1–B3 is about 2.2%.

It has been found that this construction ensures that the cross-section of the strip or panel material is exactly retained whatever the chosen curvature and whatever the material and thickness of the panel itself. It will be seen that the dimensions (volume and shape) of the accommodation space of each of the roller sets remains substantially identical and exactly corresponds to the relevant portion the cross-sectional panel dimensions. In theory one would have thought that the structure illustrated in which there is significant reduction in the dimensions A1–A3 and the dimensions B1–B3 going beyond the initial panel dimensions would not be possible. Surprisingly, however, this seemingly impossible restriction in the shape compensates for all possible spring back or material behaviour within a very useful range.

I claim:

1. Method for forming an elongate thin gauge panel having a longitudinally curved configuration, comprising the steps of:

providing an elongate thin gauge channel-shaped panel having a panel width, said channel-shaped panel having a longitudinally extending central web portion and longitudinally extending inturned rims provided along opposed longitudinal sides of said central web portion, each of said inturned rims having a free end spaced apart from said central web portion and said free ends of said inturned rims being spaced apart from one another a distance smaller than said panel width, a transverse perimeter of said channel-shaped panel from the free end of one inturned rim to the free end of the other inturned rim having an initial length;

feeding said channel-shaped panel longitudinally between a first main roller and an opposed first support roller such that said first main roller and said first support roller contact the central web portion of said channel-shaped panel along a first line of contact, said first line of contact being shorter than said panel width, and each of said inturned rims of said channel-shaped panel is supported by a respective first contoured surface defined by contiguous end portions of said first main roller and said first support roller on opposite ends of said first line of contact, said first contoured surfaces extending from respective ends of said first line of contact and terminating at respective first abutment surfaces, said free ends of said inturned rims being retained in position by said first abutment surfaces; and then feeding said channel-shaped panel longitudinally between a second main roller and an opposed second support roller such that said second main roller and said second support roller contact the central web portion of said channel-shaped panel along a second line of contact, said second line of contact being shorter than said panel width, and each of said inturned rims of said channel-shaped panel is supported by a respective second contoured surface defined by contiguous end portions of said second main roller and second support roller on opposite ends of said second line of contact, said second contoured surfaces extending form respective second abutment surfaces, said free ends of said inturned rims being retained in position by said second abutment surfaces; and then feeding said channel-shaped panel longitudinally between a third main roller and an opposed third support roller such that said third main roller and said third support roller contact the central web portion of said channel-shaped panel along a third line of contact, said third line of contact being shorter than said panel width, and each of said inturned rims of said channel-shaped panel is supported by a respective third contoured surface defined by contiguous end portions of said third main roller and said third support roller on opposite ends of said third line of contact, said third contoured surfaces extending from respective ends of said third line of contact and terminating at respective third abutment surfaces, said free ends of said inturned rims being retained in position by said third abutment surfaces;

wherein, the total length of said third contoured surfaces and said third line of contact from one third abutment surface to the other third abutment surface is shorter than said initial length of the transverse perimeter of said channel-shaped panel: and said first main roller and said first support roller and said third main roller and said third support roller are offset from said second main roller and said second support roller such that a longitudinal curvature is imparted to said channel-shaped panel by sequentially passing said channel-shaped panel between said first main roller and said first support roller, between said second main roller and said second support roller, and then between said third main roller and said third support roller.

2. The method according to claim 1, wherein said third line of contact is shorter than said first line of contact.

3. The method according to claim 2, wherein said second line of contact is shorter than said first line of contact and said second line of contact is longer than said third line of contact.

4. The method according to claim 1, wherein the axial distance between the axially outermost portions of said first contoured surfaces is greater than the axial distance between the axially outermost portions of said third contoured surfaces.

5. The method according to claim 4, wherein the axial distance between the axially outermost portions of said third contoured surfaces is between 0.5 and 4% less than the axial distance between the axially outermost portions of said first contoured surfaces.

6. A bending apparatus for imparting a longitudinal curvature to an elongate thin gauge channel-shaped panel of permanently deformable material having a panel width, and having a longitudinally extending central web portion and longitudinally extending inturned rims provided along opposed longitudinal sides of said central web portion, each of said inturned rims having a free end spaced apart from said central web portion and said free ends of said inturned rims being spaced apart from one another a distance smaller than said panel width, a transverse perimeter of said channel-shaped panel from the free end of one inturned rim to the free end of the other inturned rim having an initial length, said apparatus comprising:

an infeed roller set, an outfeed roller set and an intermediate roller set positioned between said infeed roller set and said outfeed roller set, said intermediate roller set being offset from said infeed roller set and said outfeed roller set such that a longitudinal curvature is imparted to said channel-shaped panel by sequentially passing said channel-shaped panel through said infeed roller set, said intermediate roller set and then said outfeed roller set, said infeed roller set comprising a first main roller and an opposed first support roller positioned such that said first main roller and said first support roller contact opposite surfaces of the central web portion of said channel-shaped panel along a first line of contact as said channel-shaped panel passes through said infeed roller set, said first line of contact being shorter than said panel width, and said infeed roller set having first means for supporting each of said inturned rims of said channel-shaped panel and retaining said free ends of said inturned rims in position, said first supporting means comprising respective first contoured surfaces defined by contiguous end portions of said first main roller and said first support roller on opposite axial ends of said first line of contact, said first contoured surfaces extending from respective first abutment surfaces, said first abutment surfaces retaining said free ends of said inturned rims in position, said first contoured surfaces defining respective first accommodation spaces for said inturned rims on opposite ends of said first line of contact and said first contoured rims having a shape complementary to an outer surface of the inturned rims of said channel-shaped panel, said intermediate roller set comprising a second main roller and an opposed support roller positioned such that said second main roller and said second support roller contact opposite surfaces of the central web portion of said channel-shaped panel along a second line of contact as said channel-shaped panel passes through said intermediate roller set, said second line of contact being shorter than said panel width, and said outfeed roller set comprising a third main roller and an opposed third support roller positioned such that said third main roller and said third support roller contact opposite surfaces of the central web portion of said channel-shaped panel along a third line of contact as said channel-shaped panel passes through said outfeed roller set, said third line of contact being shorter than said panel width, and said outfeed roller set having third means for supporting each of said inturned rims of said channel-shaped panel and retaining said free ends of said inturned rims in position, said third supporting means comprising respective third contoured surfaces defined by contiguous end portions of said third main roller and said third support roller on opposite axial ends of said third line of contact, said third contoured surfaces extending from respective ends of said third line of contact and terminating at respective third abutment surfaces, said third abutment surfaces retaining said free ends of said inturned rims in position, said third contoured surfaces defining respective third accommodation spaces for said inturned rims on opposite ends of said third line of contact and said third contoured surfaces having a shape complementary to the outer surface of the inturned rims of said channel-shaped panel, wherein, the total length of said third contoured surfaces and said third line of contact from one third abutment surface to the other third abutment surface is shorter than said initial length of the transverse perimeter of said channel-shaped panel; and drive means for driving at least one of said main and support rollers.

7. The apparatus according to claim 6, wherein said first accommodations spaces and said third accommodation spaces are substantially identical in size and shape.

8. The apparatus according to claim 6, wherein said intermediate roller set further includes second means for supporting each of said inturned rims of said channel-shaped panel and retaining said free ends of said inturned rims in position, said second supporting means comprising respective second contoured surfaces defined by contiguous end portions of said second main roller and said second support roller on opposite axial ends of said second line of contact, said second contoured surfaces extending from respective ends of said second line of contact and terminating at respective second abutment surfaces, said second abutment surfaces retaining said free ends of said inturned rims in position, said second contoured surfaces defining respective second accommodation spaces for said inturned rims on opposite ends of said second line of contact and said second contoured surfaces having a shape complementary to the outer surface of the inturned rims of said channel-shaped panel.

9. The apparatus according to claim 8, wherein said first accommodations spaces, said second accommodation spaces and said third accommodation spaces are substantially identical in size and shape.

10. The apparatus according to claim 6, wherein the total length of said first contoured surfaces and said first line of contact from one first abutment surface to the other first abutment surface is shorter than said initial length of the transverse perimeter of said channel-shaped panel and is greater than the total length of said third contoured surfaces and said third line of contact from one third abutment surface to the other third abutment surface.

11. The apparatus according to claim 6, wherein the axial distance between said third accommodation spaces is less than the axial distance between said first accommodation spaces.

12. The apparatus according to claim 8, wherein the axial distance between said second accommodation spaces is greater than the axial distances between said third accommodation spaces and less than the axial distance between said first accommodation spaces.

13. The apparatus according to claim 6, wherein the axial distance between the axially outermost portions of said first contoured surfaces is greater than the axial distance between the axially outermost portions of said third contoured surfaces.

14. The apparatus according to claim 13, wherein the axial distance between the axially outermost portions of said third contoured surfaces is between 0.5 and 4% less than the axial distance between the axially outermost portions of said first contoured surfaces.

* * * * *